US011168893B2

(12) United States Patent
Bussotto et al.

(10) Patent No.: US 11,168,893 B2
(45) Date of Patent: Nov. 9, 2021

(54) COOKTOPS

(71) Applicant: Elica S.p.A., Fabriano (IT)

(72) Inventors: Lorenzo Bussotto, Fabriano (IT); Antonello Gargiulo, Fabriano (IT)

(73) Assignee: ELICA S.P.A., Fabriano (IT)

( * ) Notice: Subject to any disclaimer, the term of this patent is extended or adjusted under 35 U.S.C. 154(b) by 30 days.

(21) Appl. No.: 16/638,724

(22) PCT Filed: Aug. 13, 2018

(86) PCT No.: PCT/IB2018/056085
§ 371 (c)(1),
(2) Date: Feb. 12, 2020

(87) PCT Pub. No.: WO2019/038632
PCT Pub. Date: Feb. 28, 2019

(65) Prior Publication Data

US 2021/0148580 A1 May 20, 2021

(30) Foreign Application Priority Data

Aug. 23, 2017 (IT) ..... 102017000095549

(51) Int. Cl.
*F24C 15/20* (2006.01)

(52) U.S. Cl.
CPC ..... *F24C 15/2042* (2013.01); *F24C 15/2035* (2013.01)

(58) Field of Classification Search
CPC .. F24C 15/20; F24C 15/2071; F24C 15/2035; F24C 15/2042
See application file for complete search history.

(56) References Cited

U.S. PATENT DOCUMENTS 4,446,849 A * 5/1984 McFarland ..... F24C 15/2042 126/299 R
6,455,818 B1 9/2002 Arntz et al.
(Continued)

FOREIGN PATENT DOCUMENTS

DE 102013007722 A1 11/2014
DE 202016104283 U1 8/2016
(Continued)

OTHER PUBLICATIONS

International Search Report and Written Opinion of the International Searching Authority, dated Nov. 9, 2018, in corresponding International Application No. PCT/IB2018/056085, 15 pages.

*Primary Examiner* — David J Laux
*Assistant Examiner* — Nikhil P Mashruwala
(74) *Attorney, Agent, or Firm* — MH2 Technology Law Group LLP

(57) ABSTRACT

A cooktop may include: a support having a suction opening, top and bottom surfaces, and a connecting edge, with front and rear surfaces, between the top and bottom surfaces; one or more heating elements arranged on the support; and a suction device, connected in fluid communication with the suction opening and configured to draw in cooking fumes, including first and second filters. The first filter may have a first filter element in a first seat, wherein the first seat is accessible through the suction opening. The second filter, located downstream from the first filter, may have second filter elements in a second seat. The first seat may be interposed between the suction opening and the second seat. The second seat may be accessible through the first seat, to allow extraction and/or insertion of the second filter elements through the suction opening, passing through the first seat.

10 Claims, 4 Drawing Sheets

(56) References Cited

U.S. PATENT DOCUMENTS

| | | | | |
|---|---|---|---|---|
| 7,687,748 | B2 * | 3/2010 | Gagas | H05B 6/1263 219/623 |
| 8,312,873 | B2 * | 11/2012 | Gagas | F24C 15/2092 126/299 D |
| 10,006,641 | B2 * | 6/2018 | Bruckbauer | F24C 15/2042 |
| 10,041,687 | B1 * | 8/2018 | Caneba | F24C 15/20 |
| 10,712,019 | B2 * | 7/2020 | Adam | F24C 15/14 |
| 2007/0062513 | A1 | 3/2007 | Gagas | |
| 2010/0012110 | A1 * | 1/2010 | Feisthammel | F24C 15/2042 126/299 D |
| 2012/0204855 | A1 * | 8/2012 | Huber | F24C 15/2035 126/299 R |
| 2016/0177972 | A1 * | 6/2016 | Santucci | F04D 29/624 417/423.14 |
| 2019/0032925 | A1 | 1/2019 | Gargiulo et al. | |
| 2019/0195511 | A1 * | 6/2019 | Neunhauserer | F24C 15/2021 |

FOREIGN PATENT DOCUMENTS

| | | | |
|---|---|---|---|
| DE | 102016113867 | A1 | 2/2018 |
| GB | 2097526 | A | 11/1982 |

* cited by examiner

COOKTOPS

CROSS-REFERENCE TO RELATED APPLICATION(S)

This application is a national stage entry from International Application No. PCT/IB2018/056085, filed on Aug. 13, 2018, in the Receiving Office ("RO/IB") of the International Bureau of the World Intellectual Property Organization ("WIPO"), published as International Publication No. WO 2019/038632 A1 on Feb. 28, 2019; International Application No. PCT/IB2018/056085 claims priority under 35 U.S.C. § 119 from Italian Patent Application No. 102017000095549, filed on Aug. 23, 2017, in the Italian Patent and Trademark Office ("IPTO"); the entire contents of all of these applications are incorporated herein by reference.

TECHNICAL FIELD

The present invention relates to a cooktop.

Particularly, but without limitation, the present invention relates to a cooktop integrating a hood that is commercially available under the name of "downdraft hood", as defined in the preamble of claim 1.

Background Art

Domestic hoods have become a common feature in residential kitchens, due to their undisputed usefulness in extracting food preparation gases, i.e. vapors generated during by cooking. The provision of domestic hoods that can effectively remove cooking vapors generated during food preparation is of increasing importance.

For this purpose, hoods have been developed that can both extract air and exhaust the extracted air out of the house, using an intake section, and filter such air and recirculate it into the domestic environment.

Downdraft hoods are among the variety of commercially available hoods, and are often integrated either in a cooktop or in a kitchen furniture countertop. Namely, a downdraft hood is configured to generate a crossflow that is higher than the ascending flow rate of cooking steam, so that such steam is extracted toward the cooktop in a vertical downward direction.

One example of these downdraft hoods, which is particularly integrated in a cooktop, is shown in Patent Application IT 102016000034820, by the Applicant hereof.

This document discloses a cooktop comprising a support. Such support has a top surface and a bottom surface. Cooking areas are defined on the top surface which have the purpose of accommodating a heating element.

The support element has a suction opening for drawing cooking fumes. The cooktop further comprises a suction duct, in fluid communication with the suction opening. A centrifugal fan is in fluid communication with the suction opening, and particularly has an inlet port in fluid communication with the suction duct. The fan ejects the fumes through a outlet scroll. A motor is associated with the centrifugal fan to set it into rotation.

For treatment of cooking fumes, the prior art downdraft hood has a first filter, usually consisting of a metal grid, which is adapted to facilitate condensation of suspended liquid or semi-liquid particulates, such as fats, in the cooking fumes.

The hood also comprises a second filter adapted to absorb odors from the cooking fumes. This filter comprises one or more elements active-carbon filter elements.

Both filters require periodic maintenance. The first filter requires removal of the grid for cleaning. The second filter requires replacement of the filter elements once they have reached saturation.

In the prior art downdraft hood, the grid may be generally removed through the suction opening of the hood. An additional opening is formed on the outer surface of the support, level with the second filter, to provide access to the filter elements and allow replacement thereof. Such additional opening is preferably formed in a rear area of the support, or of a portion of the lower surface, such that the aesthetics of the exposed parts of the downdraft hood is unaffected.

DE 102013007722, DE 102016113867 and US 2007062513 describe exemplary downdraft suction hoods only having access to one filter only, that directly faces the suction opening.

Problem of the Prior Art

One drawback is that the support area in which the additional opening is formed for maintenance of the second filter is often placed in a poorly accessible area of the hood. Accordingly, the hood may sometimes have to be displaced or at least partially disassembled to gain access to the second filter and replace the active-carbon filter elements.

OBJECT OF THE INVENTION

Therefore, the technical purpose of the present invention is to provide a cooktop that can obviate the above mentioned prior art drawbacks.

Particularly, an object of the present invention is to provide a cooktop having a downdraft hood that allows an easy maintenance of the hood filters.

The aforementioned technical purpose and objects are substantially fulfilled by a cooktop that comprises the technical features as disclosed in one or more of the accompanying claims.

Particularly, a cooktop of the present invention comprises a support that has a suction opening. One or more heating elements are placed on the support, particularly proximate to the opening.

The cooktop also comprises suction means, connected in fluid communication with the suction opening. These suction means are configured to draw in cooking fumes proximate to the heating elements. The suction means comprise first and second filters.

The first filter has a first seat, and comprises a first filter element in the first seat. The first filter element is configured to facilitate condensation of liquid or semiliquid particles in the cooking fumes. The first seat is designed to be accessible through the suction opening, to allow the extraction and/or insertion of the first filtering.

The second filter is placed downstream from the first filter and has a second seat which is designed to contain a plurality of second filter elements. These second filter elements are preferably of the active-carbon type. The second seat is accessible through the first seat, to thereby allow the extraction and/or insertion of the second filter elements through the suction opening.

Advantages of the Invention

The cooktop solves the aforementioned technical problem. In fact, communication of the seat of the second filter with the seat of the first filter allows the filtering elements of both filters to be pulled out through the suction opening. This simplifies maintenance of the cooktop filters, because the suction opening is placed in an easily accessible region of the support. This will avoid the need to disassemble or displace the cooktop.

BRIEF DESCRIPTION OF THE FIGURES

Further features and advantages of the present invention will result more clearly from the illustrative, non-limiting description of a preferred, non-exclusive embodiment of a cooktop as shown in the annexed drawings, in which.

DETAILED DESCRIPTION

Figure 1:
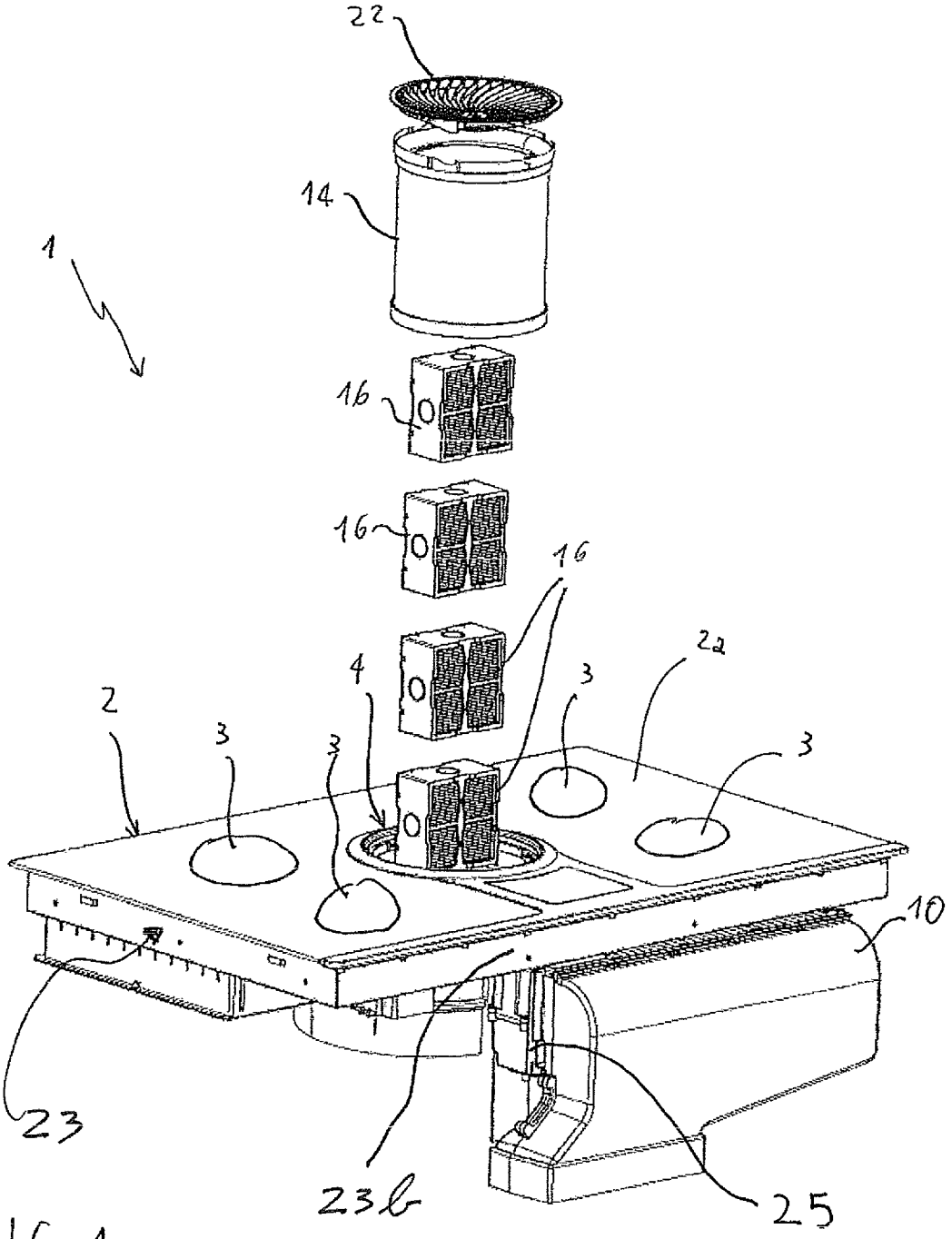
FIG. 1 is a partially exploded perspective view of a cooktop of the present invention.

The apparatus of the annexed figures shall be deemed to be schematically illustrated, not necessarily drawn to scale, and not necessarily representing the actual proportions of its parts.

Although this is not expressly shown, the individual features described with reference to each embodiment shall be intended as auxiliary and/or interchangeable with other features, as described with reference to other embodiments.

Referring to the annexed figures, numeral 1 generally designates a cooktop of the present invention.

The cooktop 1 comprises a support 2.

The support 2 has a substantially rectangular shape and has a substantially horizontally orientation during operation.

With this orientation, the support 2 has a top surface 2*a* and a bottom surface 2*b*.

Furthermore, the support 2 has a connecting edge 23 between the top surface 2*a* and the bottom surface 2*b*, such connecting edge 23 defining a front surface 23*a* and a rear surface 23*b* opposed to the front surface 23*a*.

The cooktop 1 comprises one or more heating elements 3 arranged on the support 2, particularly on the top surface 2*a*. These heating elements 3 may be of any type already known to the skilled person such as, for example, gas burners, electric resistors or induction circuits.

The cooktop 1 has a suction opening 4 formed on the support 2 and particularly on the top surface 2*a*.

In the illustrated embodiment, the suction opening 4 has a circular shape. In certain alternative embodiments, the suction opening 4 may have any shape.

It shall be noted that the aforementioned heating elements 3 are located proximate to the suction opening 4, for the cooking fumes to be easily drawn in from containers placed on top of the heating elements 3.

The suction opening 4 has a closure member 22, which is defined, for example, by a grid. The closure member 22 particularly has the same shape and size as the suction opening 4, The closure member 22 is designed to allow the passage of liquids or gases and to block large solid objects.

The cooktop also comprises suction means 5 in fluid communication with the suction opening 4. These suction means 5 are configured to draw in cooking fumes in the vicinity of the heating elements. Preferably, the suction means 5 comprise a fan (not shown), more preferably of the centrifugal type.

More in detail, the cooktop 1 comprises a suction duct 6. This suction duct 6 is in fluid communication with the outside environment via the aforementioned suction opening 4. The suction duct 6 is delimited by a portion of the bottom surface 2*b* of the support 2, a side wall 7 and a bottom wall. As shown for example in FIG. 4, the side wall 7 projects from the bottom surface 2*b* of the support 2. The bottom wall of the suction duct 6, not shown in FIG. 4, is opposed to the bottom surface 2*b* of the support 2 and is connected to the edge of the side wall 7 opposed to support 2.

In the above described embodiment, the cooktop 1 comprises a collecting tray (not shown) which defines part of the suction duct 6. This collecting tray incorporates the aforementioned bottom wall of the support 2 and, in operation, is connected to the side wall 7. The collecting tray has the purpose to hold and receive any liquids or solids infiltrating through the suction opening 4 into the suction duct 6. The collecting tray is advantageously removable to be emptied and cleaned, as substantially known in the art.

Figure 2:
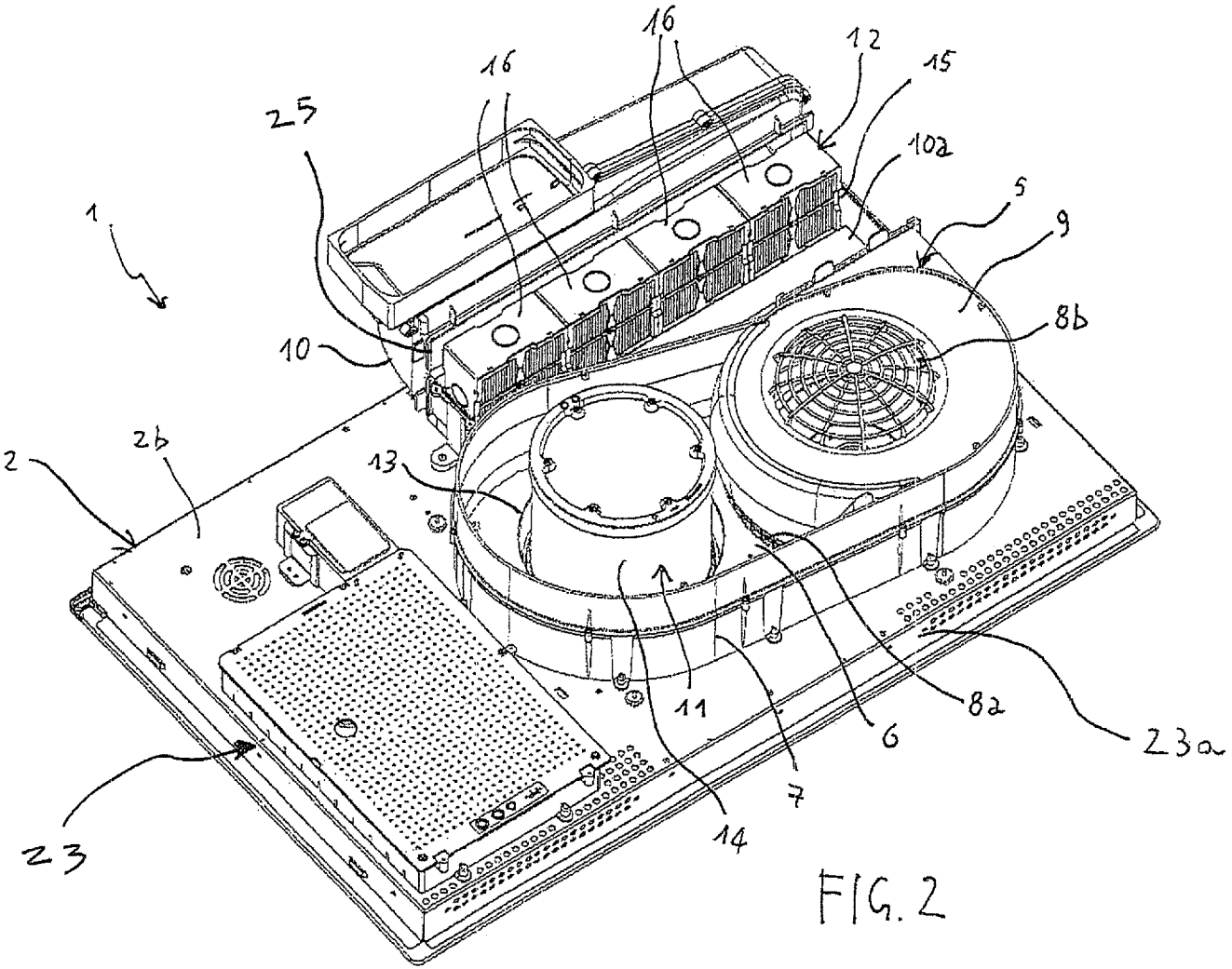
FIG. 2 is a bottom perspective bottom view of the cooktop of FIG. 1.
Figure 4:
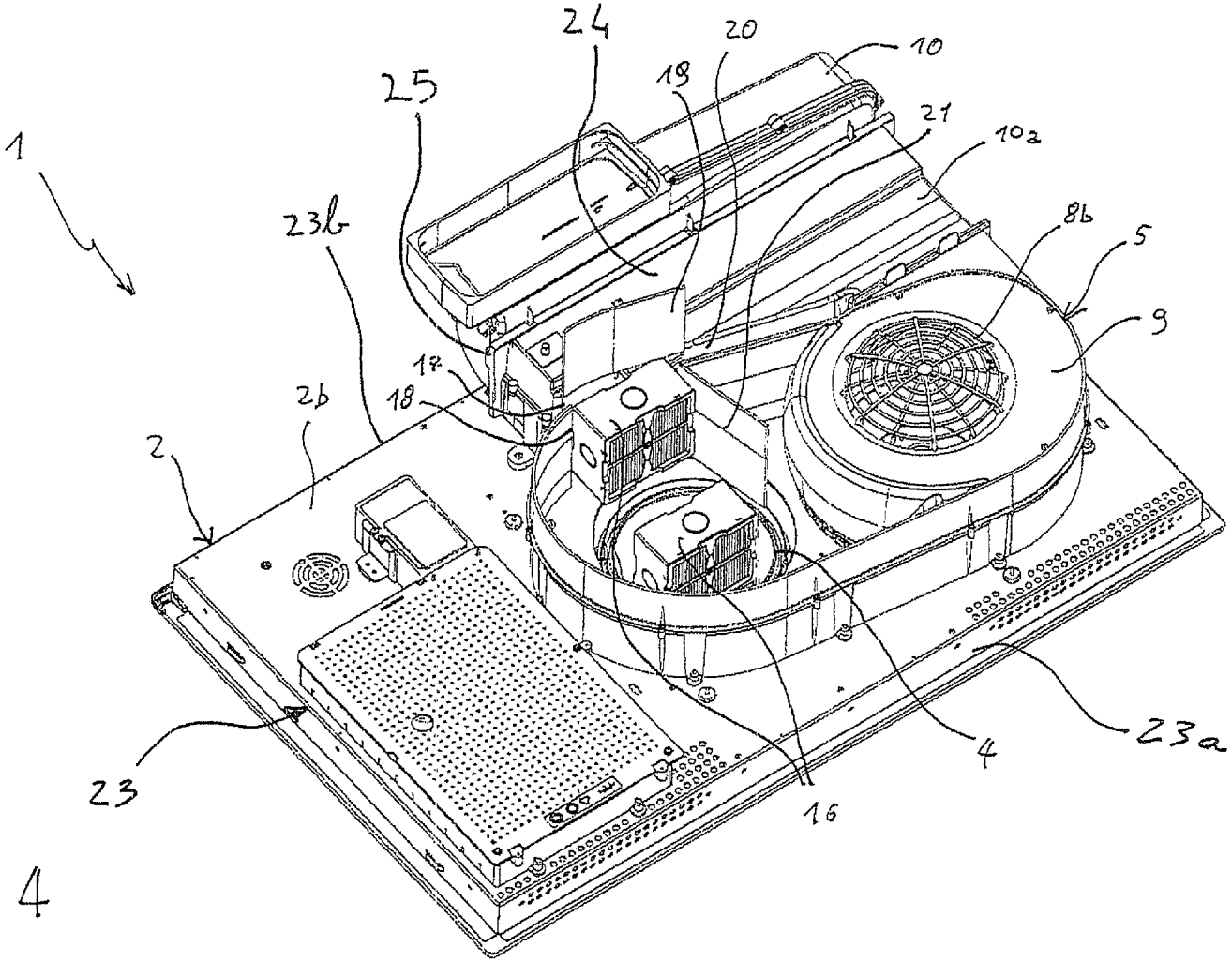
FIG. 4 is a perspective bottom view of the cooktop of FIGS. 1 and 2 while the filter elements are being pulled out.

Particularly referring to FIGS. 2 and 4, the fan is enclosed in a casing 9, and is in fluid communication with the suction duct 6 through two grids 8*a*, 8*b* formed on the casing 9. Namely, a first grid 8*a* is placed on an outer peripheral zone of the casing 9 and connects the suction duct 6 with a central area of the fan through a gap formed between the casing 9 and the bottom surface 2*b* of the support 2. Conversely, the second grid 8*b* is located substantially level with the central area of the fan.

The cooktop 1 also comprises an exhaust duct 10, located downstream from the suction means 5.

The exhaust duct 10 has a peripheral wall 20 located proximate to the suction duct 6. Namely, the perimeter wall 20 faces a portion of the side wall 7.

It shall be noted that, in the above described embodiment, the exhaust duct 10 comprises a divergent duct 10*a* directly connected to the fan. An additional duct (not shown, because it is not part of the cooktop 1) may be connected downstream from such divergent duct 10*a*. The shape and size of such additional duct can vary according to the particular installation of the cooktop 1.

Particularly referring to FIG. 2, the suction means 5 comprise a first filter 11 and a second filter 12.

In one aspect, a second filter 12, separate from the first filter 11 and not directly facing the suction opening 4, is accessible through the first seat 13 of the first filter 11.

Particularly, the first filter 11 has a first seat 13, at least partially defined by the side wall 7 of the suction duct 6. A first filter element 14 is placed inside the first seat 13. This first filter element 14 has the purpose to facilitate condensation of liquid or semiliquid particles in the cooking fumes.

For example, the first filter element 14 may be defined by a metal grid or any type of fat filter that is known to the skilled person.

It shall be noted that the first seat 13 is designed to be accessible via the suction opening 4, in order to allow the insertion and/or extraction of the first filter element 14, i.e. the first seat 13 directly faces the suction opening 4.

By removing the first filter element 14 through the suction opening 4, the user may have free access to and is able to see both the first seat 13 and the suction duct 6.

While the first seat 13 substantially coincides with the suction duct 6 in the embodiment as described and illustrated herein, alternative embodiments may be provided, although not shown, in which the suction duct 6 extends beyond the first seat 13.

Figure 3:
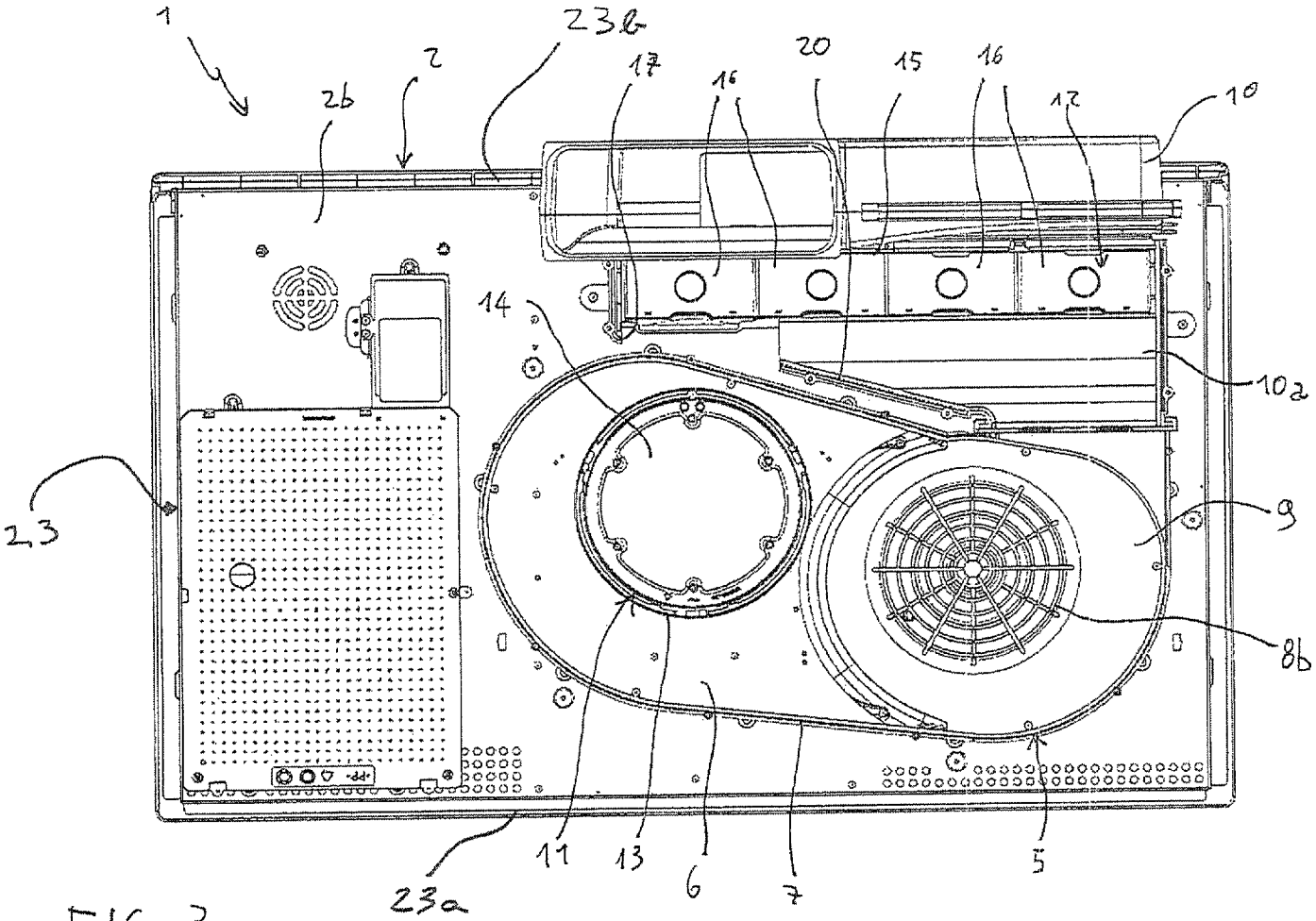
FIG. 3 is a bottom sectional view of the cooktop of FIGS. 1 and 2.

Particularly referring to FIGS. 2-4, it shall be noted that when the first filter element 14 is inserted in the first seat 13, it forms a substantially continuous plane with the top surface 2*a* of the support 2.

Once the closure member 22 and the first filter element 14 are removed, the first seat 13 creates a discontinuity on the top surface 2*a* and on the bottom surface 2*b* of the support 2. In other words, the first seat 13 appears as a cavity, which substantially extends from the suction opening 4 to the bottom wall of the conduit suction duct 6. By this arrangement, the first seat 13 can be both seen by the user and manually inspected through the suction opening 4.

As shown for example in FIG. 3, the aforementioned second filter 12 is placed downstream from the first filter 11. Particularly, the second filter 12 has a second seat 15 formed in the exhaust duct 10.

Such second seat 15 is designed to contain a plurality of second filter elements 16 adapted to remove odors from cooking fumes.

For example, the second filter elements 16 may be active-carbon filters, which are already known to the skilled person.

As shown, for instance, in FIG. 4, the second seat 15 is designed to be accessible through the first seat 13 to thereby allow the insertion and/or extraction of the second filter elements 16 through the suction opening 4.

For this purpose, the second seat 15 has a pull-out opening 17 that faces the first seat 13. Such pull-out opening 17 is particularly formed on the peripheral wall 20 of the exhaust duct 10. A door 19 is associated with the pull-out opening 17 and is able to slide toward/away with respect to the support 2 to open and/or close the pull-out opening 17.

Even more in detail, the second seat 15 is situated at the rear surface 23*b* of the connecting edge 23 and the first seat 13 is interposed between said suction opening 4 and said second seat 15. As shown in the annexed figures, the second seat 15 extends substantially between the bottom surface 2*b* in the rear area of the support 2 and a bottom wall 24 of the exhaust duct 10, as is clearly visible in FIG. 4.

Furthermore, the second seat 15 is substantially delimited by the peripheral wall 20 and a bottom wall 25 of the exhaust duct 10 projecting from the bottom surface 2*b* at the rear surface 23*b*.

Therefore, the localization of the second seat 15 at the rear surface 23*b* and in the exhaust duct 10 not only prevents the view of the second seat 15 itself to the user from the suction opening 4, but it also defines a separation with the first seat 13 and the respective first filter element 14.

In order to allow the passage of the second filter elements 16, the first seat 13 has a passage opening 18, which faces the pull-out opening 17 of the second seat 15. Particularly, the passage opening 18 is formed in the side wall 7 of the suction duct 6.

Such second seat 15 and its second filter elements 16 are accessible through the first seat 13 after removing:

the closure member 22;

the first element 14;

at least part of the peripheral wall 20;

at least part of the side wall 7, at the pull-out opening 17.

Therefore, the second seat 15 is not seen by the user from the suction opening 4, even after removal of the closure member 22, the first filter element 14, the peripheral wall 20, and the side wall 7.

Furthermore, the first seat 13 comprises a cover element 21. This cover element 21 is associated with the passage opening 18 to open and/or close it. As shown for example in FIG. 4, the cover element 21 is hinged to the side wall 7 at the passage opening 18, and is opened by pivoting relative to the side wall 7 toward the interior of the first seat 13. In certain alternative embodiments, the opening/closing mechanism of the cover element 21 may be, for example, analogous to that of the door 19 of the second seat 15.

Therefore, even after removal of the closure member 22 and the first filter element 14, and after opening the cover element 21 and the door 19, the second seat 15 is still concealed from the view of the user, as it does not directly face the suction opening 4 and/or is not proximate thereto.

More in detail, after removal of the various elements that separate the first seat 13 from the second seat 15 and vice versa, from the suction opening 4 can be substantially seen only the pull-out opening 17, which is configured to allow the second filter elements 16 to be pulled out from the second seat 15.

In other words, according to the preferred embodiment, the first seat 13 can be seen by the user and can be manually inspected, due to its position relative to the suction opening 4. However, the second seat 15 can be inspected but is not seen by the user.

Advantageously, the cooktop 1 affords convenient, quick access to a seat that is hidden to the view of the user, because it does not directly face the suction opening, through a seat that can be conversely manually inspected and seen by the user.

In order to more easily pull out the second filter elements 16, the cooktop 1 also comprises extraction means (not shown) for such second filter elements 16. The extraction means are configured to move the second filter elements 16 from the second seat 15 toward an area in front of the pull-out opening 17, for a user to pull them out. Particularly, the extraction means are at least partially inserted in the second seat 15. These extraction means are of a type that is known to the skilled person and include, for example, a tape at least partially surrounding the second filter elements 16. By pulling this tape, the user will be able to draw up the second filter elements 16 in the second seat 15 until he/she can hold them by his/her hands.

The filters in the cooktop 1 may be replaced as follows. First, the user pulls the first filter element 14 out of the first seat 13. Particularly, the user removes the closure member 22 on the suction opening 4 and later removes the first filter element 14.

In a later step, the user pulls the second filter elements 16 out of the second seat 15. For this purpose, the user opens the door 19 and the cover element 21, to thereby release the pull-out opening 17 and the passage opening 18. If needed, the collecting tray is removed in this step. The second filter elements 16 are then removed from the second seat 15 one at a time. Once the second filter element 16 located directly level with the pull-out opening 17 has been removed, the user acts on the extraction means for each of the remaining second filter elements 16 to move them into the area in front of the pull-out opening 17. After removing this second filter element 16, the user proceeds to the next until all of them have been removed.

Those skilled in the art will obviously appreciate that a number of changes and variants as described above may be made to fulfill particular requirements, without departure from the scope of the invention, as defined in the following claims.

The invention claimed is:

1. A cooktop, comprising:

a support having a suction opening, a top surface, a bottom surface, and a connecting edge between the top surface and the bottom surface, wherein the connecting edge has a front surface and a rear surface opposite to the front surface;

one or more heating elements arranged on the support in proximity to the top surface; and suction means connected in fluid communication with the suction opening and configured to draw in cooking fumes, in proximity to the heating elements, wherein the suction means comprises first and second filters;

wherein the first filter has a first seat and comprises a first filter element in the first seat, wherein the first seat is accessible through the suction opening to allow extraction and/or insertion of the first filter element, wherein the second filter, located downstream from the first filter, has a second seat, separate from the first seat, and comprises a plurality of second filter elements of different types with respect to the first filter element and inserted in the second seat, wherein the second seat is located at the rear surface of the connecting edge and the first seat is interposed between the suction opening and the second seat, and wherein the second seat is accessible through the first seat, to allow extraction and/or insertion of the second filter elements through the suction opening, passing through the first seat.

2. The cooktop of claim 1, further comprising:

an exhaust duct located downstream from the suction means at the rear surface;

wherein the second seat is formed in the exhaust duct, and wherein the exhaust duct has a peripheral wall separating the first seat from the second seat.

3. The cooktop of claim 2, wherein the second seat has a pull-out opening facing the first seat, and wherein the pull-out opening being is, defined on the peripheral wall.

4. The cooktop of claim 3, further comprising:

a door associated with the pull-out opening and configured to slide toward and/or away from the support to open and/or close the pull-out opening.

5. The cooktop of claim 3, wherein the first seat has a passage opening facing the pull-out opening to allow passage of the second filter elements.

6. The cooktop of claim 5, further comprising:

a suction duct in fluid communication with an outside environment through the suction opening;

wherein the first seat is at least partially defined by the suction duct, wherein the suction duct comprises a side wall located at the first seat and projecting from a bottom surface of the support, and, wherein the passage opening is formed in the side wall.

7. The cooktop of claim 5, wherein the first seat comprises a cover element associated with the passage opening, to open and/or close the passage opening.

8. The cooktop of claim 7, wherein the cover element is hinged to the side wall at the passage opening to open toward an interior of the first seat.

9. The cooktop of claim 3, further comprising:

extraction means to extract the second filter elements, configured to move the second filter elements into an area in front of the pull-out opening for a user to be able to pull out the second filter elements.

10. The cooktop of claim 9, wherein the extraction means are at least partially inserted in the second seat.

* * * * *